US007514856B2

(12) United States Patent
Ritz et al.

(10) Patent No.: US 7,514,856 B2
(45) Date of Patent: Apr. 7, 2009

(54) METHOD OF MANUFACTURING PARTIAL LAYERS ON LAMP BULBS

(75) Inventors: Arnd Ritz, Heinsberg (DE); Antonius J. M. Nellissen, Horst (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 499 days.

(21) Appl. No.: 10/515,743

(22) PCT Filed: May 23, 2003

(86) PCT No.: PCT/IB03/01972

§ 371 (c)(1),
(2), (4) Date: Nov. 24, 2004

(87) PCT Pub. No.: WO03/102996

PCT Pub. Date: Dec. 11, 2003

(65) Prior Publication Data

US 2005/0218809 A1 Oct. 6, 2005

(30) Foreign Application Priority Data

May 31, 2002 (DE) ..... 102 24 293

(51) Int. Cl.
*H01J 7/24* (2006.01)
*H01J 1/02* (2006.01)

(52) U.S. Cl. ..... 313/13; 427/64; 313/26; 445/23

(58) Field of Classification Search ..... 445/26, 445/9, 14, 58; 427/64–73, 77, 78; 313/634, 313/635

See application file for complete search history.

(56) References Cited

U.S. PATENT DOCUMENTS

| | | | | |
|---|---|---|---|---|
| 2,151,649 | A | 3/1939 | Birdseye et al. | |
| 2,456,376 | A | 12/1948 | Chirelstein | |
| 2,733,166 | A | 1/1956 | Schoenfeldt et al. | |
| 5,676,579 | A * | 10/1997 | Parham et al. | 445/58 |
| 5,952,768 | A | 9/1999 | Strok et al. | |
| 6,005,336 | A * | 12/1999 | Helbig et al. | 313/318.01 |

FOREIGN PATENT DOCUMENTS

| | | |
|---|---|---|
| DE | 4443354 A1 | 6/1995 |
| DE | 10151267 | 4/2003 |

* cited by examiner

*Primary Examiner*—Joseph L Williams

(57) ABSTRACT

A method of manufacturing partial layers on lamp bulbs, in which method functional layers are provided in thin-film technology, and which method includes at least providing a temporary layer on that region of the lamp bulb which will have no functional layer in the operational state of the lamp, subsequently providing the functional layer on the entire surface of the lamp bulb, and detaching the temporary layer together with the functional layer present thereon.

20 Claims, No Drawings

METHOD OF MANUFACTURING PARTIAL LAYERS ON LAMP BULBS

The invention relates to a method of manufacturing partial coating layers on lamp bulbs, in which method functional layers are provided in thin-film technology.

Functional layers in the sense of the invention are layers whose main function is to achieve a defined parameter change of a lamp.

The outer surfaces of the lamp bulbs are provided with functional layers for a wide variety of applications in lighting technology, for example for incandescent lamps or for discharge lamps. Examples of such functional layers are UV-absorbing layers on automobile lamps and IR-reflecting layers on halogen lamps. It is characteristic of the applications mentioned above that the coating must or can cover the entire surface area of the lamp bulb, which positively influences the efficiency of the manufacture of these layers.

In other applications, the primary property of the functional layer can only be achieved if the coated regions of the surface of the lamp bulb do not cover the entire surface area, i.e. a so-termed partial coating is necessary. An example of such an application with a partial coating is found in lamps in which the heat radiation properties are to be partly modified in certain regions, for example for achieving a temperature increase in a defined region of the lamp bulb in the operational state of the lamp. It is often a feature of these applications that no increased requirements are imposed on the quality of the coating as regards sharpness of contour and accuracy, layer thickness, and/or position, because usual deviations do not cause a significant impairment of the functionality of the layer.

Other applications require narrower tolerances to be observed in manufacturing technology so as to achieve the desired functionality of the layer. An example of such an application is formed by partial reflectorized portions of lamp bulbs, which are to direct the light emitted by the incandescent coil or the discharge arc within a given spatial angle so that a higher efficiency (light output) is obtained.

Thus it is known from DE 101 51 267 that a rise in efficiency (light output) in optical projection systems can be achieved by reflectorizing of a portion of the outer surface of the discharge space. In this solution, the backreflector, which is formed in particular as a layer, should have at least one opening which is usually in a defined position opposite the backreflector and which renders possible the desired light emission in the direction of the main reflector of the high-pressure gas discharge lamp. The manufacture of such an opening or such a partial coating is technologically complicated, in particular in an industrial mass manufacturing process.

It may also be desirable in applications with coatings on the light-transmitting portion of the lamp bulb, however, to realize further portions of the surface of the lamp bulb such as, for example, the lamp ends or the electrical contacts without any coating. If thin-film methods such as, for example, physical vapor deposition, sputtering, or chemical vapor deposition are used, which coat the surfaces arranged opposite the coating source in a regular manner, the method inevitably will also coat the electrical contacts or the lamp ends. No exact, sharp layer contour of the functional layer can be achieved, even with the use of coverings for the surface areas to be kept free in the form of screens or product holders, which are to prevent a coating of these surfaces. Narrow manufacturing tolerances can often not be maintained in mass manufacture owing to diffusion or reflection of the coating material, in particular during the coating process. If the desired functionality is to be guaranteed, additional process steps are necessary, which often lead to additional expenditure and resource requirements.

The expression "accurate" used in connection with the contour of the functional layer denotes the degree to which the actually coated region corresponds to what is desired; "sharp" denotes the degree of correspondence thereto of the layer thickness gradient in the contour region. The contour has a high sharpness if there is only a small tapering effect, i.e. the layer thickness does not distinguish itself from the layer thickness of the adjoining layer regions until immediately at the contour.

A relatively better, but still technologically more complicated solution for layer structuring is the use of screens, which are arranged very close to the surface to be coated during coating. These screens are suitable for coating methods, for example sputtering, with a small intrinsic directional effect. The use of such prefabricated screens has the following particular disadvantages for applications with high requirements imposed on the accuracy and the sharpness of the layer: the screens must be adapted individually to the respective product; the method implies that the screens are also coated, so that cleaning or exchange is necessary; the screens make the handling for loading and unloading of the coating device more difficult; and screens with sharp edges in the μm range necessary for obtaining sharp contours are very sensitive to damage in industrial mass manufacture.

It is an object of the invention accordingly to provide a method of the kind mentioned in the opening paragraph which renders it possible to manufacture partial coatings on lamp bulbs with a high contour sharpness and accuracy in an effective manner in an industrial mass manufacturing process, and to provide a lamp bulb with such a partial coating.

The object of the invention is achieved in that the method comprises at least the steps of: providing a temporary layer on that region of the lamp bulb which will have no functional layer in the operational state of the lamp, subsequently providing the functional layer on the entire surface of the lamp bulb, and detaching the temporary layer.

According to the invention, a thin temporary layer is provided on that region of the lamp bulb which will have no functional layer in the operational state of the lamp. The contour of this layer has a contour sharpness and accuracy comparable to those of the desired contour of the functional layer and accordingly acts as a screen lying fully against the lamp bulb during the provision of the functional layer.

All known standard methods in thin-film technology may be used for providing the temporary layer as long as they are capable of providing layers of the required contour sharpness and accuracy on three-dimensional bodies limited in time.

The method used for providing the temporary layer and the material to be chosen for this layer, and the method of removing the temporary layer are to be mutually attuned according to the invention such that in particular the required contour sharpness and accuracy as well as a technically simple removal are safeguarded. The temporary layer may be comparatively thinly dimensioned in comparison with a conventional screen, which is usually constructed as a separate component, because the required support function or mechanical stability of this layer is realized in particular by the subjacent surface of the lamp bulb. A sharp contour is rendered possible thereby, and the consequences of the tapering effect are substantially avoided.

All known methods may be used for removing the temporary layer, in particular those methods related to thin-film technology and suitable for detaching the temporary layer from a three-dimensional body, in particular without causing damage to the contour in the functional layer formed as a negative to the contour of the temporary layers.

The choice of the respective removal mechanism is to be adapted to the application in question. For example, the removal may take place by dissolving of the temporary layer in a cleaning bath in the technologically simplest case, during which the functional layer or at least portions thereof present on the temporary layer is or are also dissolved. If necessary, the dissolving is supported or triggered in known manner by the exertion of mechanical force, energy supply, or a temperature effect.

Besides the three process steps essential to the invention, the claimed method may comprise further process steps which may take place before or after the former process steps. Such additional process steps are, for example, a separate preparatory treatment of the surface of the lamp bulb and/or of the temporary layer. Depending on the material used, a treatment may be necessary for preparing the layer for the subsequent process step. For example, temperature treatments may be necessary for fixing the layer in its geometry or curing it, so as to enhance its resistance to damage. It may furthermore be useful to degas the temporary layer so as to render possible or accelerate subsequent vacuum processes.

The dependent claims relate to advantageous further embodiments of the invention.

An advantageous embodiment of the method according to the invention can be achieved in that the step of providing a temporary layer on that region of the lamp bulb which will have no functional layer in the operational state of the lamp further comprises that the contour of the temporary layer after and/or during the application thereof is adapted to a given value as regards its sharpness and accuracy, layer thickness, location, and/or permanence of shape. This adaptation is usually achieved by measuring the actual state of the temporary layer, comparing it with the desired state, and the provision of suitable measures for correction, taking into account the given tolerances. This is particularly preferred in the case in which the chosen method of providing the temporary layer has not yet achieved the required parameters mentioned above. It is regularly necessary then in particular to remove excess material from the temporary layer. This is possible, for example, in the still liquid state, i.e. before evaporation of an incorporated solvent, or after curing.

It is furthermore preferred to use suitable scrapers for the mechanical detachment of the excess material. The removal may alternatively or additionally take place by a thermal effect and/or energy supply, in particular by a laser.

In one embodiment, the provision of the temporary layer takes place in particular by dipping, spraying, printing, or dispensing techniques.

Dip coating, in which the lamp bulb to be provided with the temporary layer according to the invention is dipped into the liquefied material of the temporary layer and is subsequently pulled out again, is a technologically simple and efficient method. The method is particularly suitable for coating lamp ends and electrical contacts.

A spraying method which is known per se is also well suited to industrial mass manufacture, in particular if the geometric arrangements of the lamp bulb render this possible, i.e. for example if there are no undercut portions.

Printing techniques known from the prior art are also preferred for certain applications, special attention being given to a correct choice of a suitable material for the temporary layer.

In an embodiment, means are present on the lamp bulb within that region of the lamp bulb which will have no functional layer in the operational state of the lamp, and remote from the contour thereof or in the temporary layer, which means at least support the subsequent detaching of the temporary layer. The use of the means supporting the detaching process is to be adapted in particular to the detaching mechanism chosen for the respective application. For example, chemical means may be provided in small quantities on said surface areas, serving as catalysts or triggering agents which start and accelerate the chemical detaching process.

It is furthermore preferred for a quicker removal that mechanical means, in particular ultrasonic means, thermal means, chemical means, in particular dissolving agents, and/or energy supply, in particular by a laser, are used.

It is preferred for the material of the temporary layer that known materials from semiconductor technology, in particular standard coatings from semiconductor technology with or without photosensitivity are used. Besides the materials mentioned above and their mixtures, further materials may be used within the scope of the invention, which materials may be tested for their usefulness, for example by means of suitable experiments.

The object of the invention is furthermore achieved by means of a lamp bulb with a partial coating.

Further details, features, and advantages of the invention will become apparent from the ensuing description of a preferred embodiment.

A first embodiment relates to a partial coating on a UHP lamp having a bulb diameter of approximately 9 mm, of which only the lamp ends and the electrical contacts are uncoated after a treatment by the method according to the invention.

First the entire surface area of the lamp bulb is given a preparatory cleaning in a usual cleaning process, for example a low-pressure plasma cleaning or a degreasing method with surfactants. A usual dipping method is used for providing the temporary layer on the lamp bulb regions mentioned above, such that the lamp ends and the electrical contacts are wetted in a usual manner so that an approximately 0.5 to 100 μm, preferably approximately 5 to 20 μm thick, intrinsically closed layer is formed. After curing of the temporary layer, which consists of a Novolack, the functional layer is provided to a layer thickness of approximately 0.1 to 200 μm, preferably approximately 0.1 to 10 μm, on the entire surface area of the lamp bulb in a PVD (physical vapor deposition) process. The deposition of this layer consisting of optical materials such as silicon oxide ($SiO_2$), $TiO_2$, $Ta_2O_5$, or $ZrO_2$, is realized at a process temperature in a low temperature range (up to a maximum of 300° C.). The functional layer serves as a so-called cool-light mirror and is constructed as an interference filter which comprises a regular arrangement of several layers. Then the temporary layer is dissolved in a cleaning bath at a temperature of approximately 35° C., organic solvents usual for the purpose being used for cleaning. To support the dissolving process, the lamp bulb is subjected to ultrasound in a known manner for approximately 120 min.

UHP (ultra high performance) lamps, which belong to the high-pressure gas discharge lamps or HID (high intensity discharge) lamps, are used by preference inter alia for projection purposes because of their optical properties. The term UHP lamp (Philips) also relates to UHP-type lamps from other manufacturers within the scope of the invention.

A second embodiment also relates to a partial coating of a UHP lamp with a bulb diameter of approximately 9 mm, where the functional layer again serves as a so-termed cool-light mirror and is formed as an interference filter.

This reflectorized portion is a partial coating which leaves a portion of the outer surface of the discharge vessel, i.e. the region of the light emission window, free from any coating.

First the entire surface of the lamp bulb is given a preparatory cleaning in a usual standard cleaning process, for example a degreasing process in which surfactants are used. A usual dispenser technology is used for applying the temporary layer to the lamp bulb regions mentioned above, which process takes place by means of a nozzle. The temporary layer is deposited by the nozzle in a scanning scheme in which the lamp rotates about its longitudinal axis, while the nozzle is suitably moved in a meridional plane of the lamp. The surface to be coated is thus traversed in a spiraling movement. Then the deposition of the functional layer is prepared in that the lamp is stored for approximately 30 min at approximately 90° C. in a vacuum oven, so that the mechanical properties of the temporary layer are stabilized and the solvent present therein is evolved and evacuated. The deposition of the functional layer and the subsequent process steps take place, for example, as in the first embodiment.

The invention claimed is:

1. A method of manufacturing partial coating layers on lamp bulbs, wherein layers are provided in thin-film technology, wherein the method comprises the acts of:

providing a temporary layer on a region of the lamp bulb which will have no functional layer in an operational state of the lamp;

providing the functional layer on an entire surface of the lamp bulb; and detaching the temporary layer;

wherein the act of providing a temporary layer on the region of the lamp bulb which will have no functional layer in the operational state of the lamp bulb further comprises that the temporary layer after and/or during an application thereof is adapted to a given value based on the temporary layer's contour sharpness, accuracy, location, and permanence of shape.

2. The method as claimed in claim 1, wherein the act of providing a temporary layer on the region of the lamp bulb which will have no functional layer in the operational state of the lamp bulb further comprises that the temporary layer after and/or during the application thereof is adapted to a given value as regards its layer thickness.

3. The method as claimed in claim 2, wherein the corrective adaptation of the contour, in particular the contour sharpness, is achieved by mechanical means, in particular by means of scrapers, thermal effects, and/or the supply of energy, in particular by laser means.

4. The method as claimed in claim 2, wherein the provision of the temporary layer takes place in particular by dipping, spraying, printing, or dispensing techniques.

5. The method as claimed in claim 2, wherein means are present on the lamp bulb within the region of the lamp bulb which will have no functional layer in the operational state of the lamp bulb, and remote from the contour thereof and/or in the temporary layer, which means at least support the subsequent detaching of the temporary layer.

6. The method as claimed in claim 1, wherein the act of detaching the temporary layer further comprises that mechanical means, in particular ultrasonic means, thermal means, chemical means, in particular dissolving agents, and/or energy supply, in particular by a laser, are used.

7. The method as claimed in claim 1, wherein the temporary layer known materials from semiconductor technology are used, in particular standard lacquers known from semiconductor technology with or without photosensitivity.

8. The method as claimed in claim 1, wherein the corrective adaptation of the contour, in particular the contour sharpness, is achieved by mechanical means, in particular by means of scrapers, thermal effects, and/or the supply of energy, in particular by laser means.

9. The method as claimed in claim 1, wherein the provision of the temporary layer takes place in particular by dipping, spraying, printing, or dispensing techniques.

10. The method as claimed in claim 1, wherein the means are present on the lamp bulb within the region of the lamp bulb which will have no functional layer in the operational state of the lamp, and remote from the contour thereof and/or in the temporary layer, which means at least support the subsequent detaching of the temporary layer.

11. The method as claimed in claim 1, wherein the temporary layer is a Novolack layer.

12. The method as claimed in claim 1, wherein the temporary layer is 5 to 20 μm thick.

13. The method as claimed in claim 1, wherein the act of providing the functional layer comprising an act of depositing the functional layer at a temperature less than or equal to 300° C.

14. The method as claimed in claim 1, wherein the act of detaching the temporary layer further comprises dissolving the temporary layer in a cleaning bath at a temperature of substantially 35° C.

15. The method as claimed in claim 1, wherein the act of detaching the temporary layer further comprises subjecting the temporary layer to ultrasound.

16. The method as claimed in claim 1, wherein the act of providing the temporary layer further comprises an act of depositing the temporary layer by a nozzle in which the lamp bulb rotates about a longitudinal axis of the lamp bulb while the nozzle is suitably moved in a meridional plane of the lamp bulb.

17. The method as claimed in claim 16, wherein the lamp bulb surface is traversed in a spiraling movement while being coated.

18. The method as claimed in claim 1, wherein the act of providing the temporary layer comprises an act of removing excess material by a laser.

19. A method of manufacturing partial coating layers on lamp bulbs, wherein layers are provided in thin-film technology, wherein the method comprises the acts of:

depositing a temporary layer on a region of the lamp bulb which will have no functional layer in an operational state of the lamp, wherein the temporary layer is adapted to a given value based on the temporary layer's contour sharpness, accuracy, location, and permanence of shape;

depositing the functional layer on an entire surface of the lamp bulb; and detaching the temporary layer from the bulb.

20. The method as claimed in claim 19, wherein the act of depositing the temporary layer further comprises an act of depositing the temporary layer by a nozzle in which the lamp bulb rotates about a longitudinal axis of the lamp bulb while the nozzle is suitably moved in a meridional plane of the lamp bulb.

* * * * *